US007295797B2

(12) United States Patent
Osbourne

(10) Patent No.: US 7,295,797 B2
(45) Date of Patent: Nov. 13, 2007

(54) CHARGE GENERATING DEVICE AND METHOD THEREOF FOR REDUCING DEVELOPMENT OF NITROGEN OXIDE SPECIES FORMATION

(75) Inventor: William G. Osbourne, Webster, NY (US)

(73) Assignee: Xerox Corporation, Stamford, CT (US)

( * ) Notice: Subject to any disclaimer, the term of this patent is extended or adjusted under 35 U.S.C. 154(b) by 202 days.

(21) Appl. No.: 11/170,606

(22) Filed: Jun. 30, 2005

(65) Prior Publication Data

US 2007/0003322 A1 Jan. 4, 2007

(51) Int. Cl.
*G03G 15/02* (2006.01)

(52) U.S. Cl. ..... 399/170; 399/171; 399/172

(58) Field of Classification Search ..... 399/170, 399/171, 172, 173
See application file for complete search history.

(56) References Cited

U.S. PATENT DOCUMENTS 4,842,973 A 6/1989 Badesha et al.
6,060,708 A * 5/2000 Grubner ..... 250/324
6,807,389 B2 10/2004 Facci et al.
6,823,157 B2 11/2004 Foltz

* cited by examiner

*Primary Examiner*—Hoang Ngo
(74) *Attorney, Agent, or Firm*—Pillsbury Winthrop Shaw Pittman, LLP

(57) ABSTRACT

A charge generating device comprising a discharge electrode; and a conductive shield comprising a nonconductive substrate coated with one or more materials selected from the group including gold, platinum, lead, titanium and alloys thereof.

20 Claims, 1 Drawing Sheet

FIG. 1
PRIOR ART
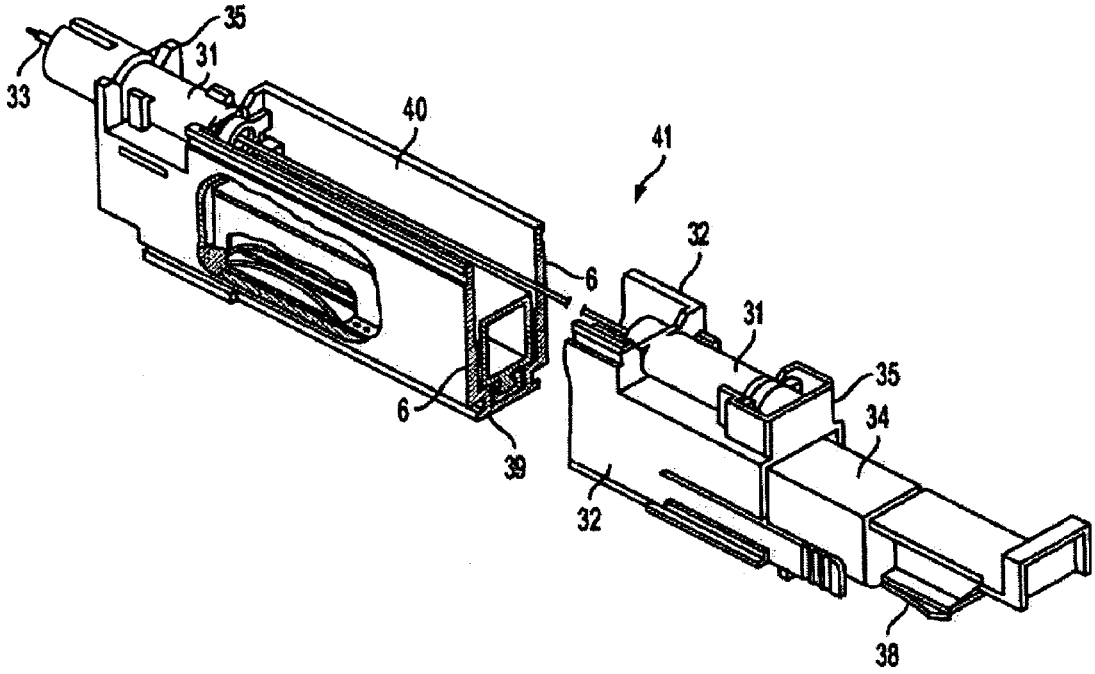
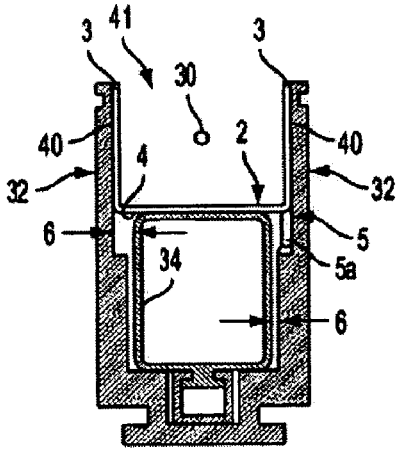
FIG. 2
PRIOR ART

CHARGE GENERATING DEVICE AND METHOD THEREOF FOR REDUCING DEVELOPMENT OF NITROGEN OXIDE SPECIES FORMATION

BACKGROUND

All references cited in this specification, and their references, are incorporated by reference herein where appropriate for teachings of additional or alternative details, features, and/or technical background.

Disclosed in the embodiments herein is a charge generating device, such as a corona, having a charge generating shield onto which titanium has been vacuum deposited.

Generally, the process of electrostatographic reproduction is initiated by substantially uniformly charging a photoreceptive member, followed by exposing a light image of an original document thereon. Exposing the charged photoreceptive member to a light image discharges a photoconductive surface layer in areas corresponding to non-image areas in the original document, while maintaining the charge on image areas for creating an electrostatic latent image of the original document on the photoreceptive member. This latent image is subsequently developed into a visible image by a process in which a charged developing material is deposited onto the photoconductive surface layer, such that the developing material is attracted to the charged image areas on the photoreceptive member. Thereafter, the developing material is transferred from the photoreceptive member to a copy sheet or some other image support substrate to which the image may be permanently affixed for producing a reproduction of the original document. In a final step in the process, the photoconductive surface layer of the photoreceptive member is cleaned to remove any residual developing material therefrom, in preparation for successive imaging cycles.

Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

The above described electrostatographic reproduction process is well known and is useful for both digital copying and printing as well as for light lens copying from an original. In many of these applications, the process described above operates to form a latent image on an imaging member by discharge of the charge in locations in which light from a lens, laser, or LED discharges a charge. Such printing processes typically develop toner on the discharged area, known as DAD, or "write black" systems. Light lens generated image systems typically develop toner on the charged areas, known as CAD, or "write white" systems. The embodiments of the present disclosure apply to both DAD and CAD systems.

Generally, corona generating devices are utilized to apply a charge to the photoreceptive member. In a typical device, a suspended electrode, or so-called coronode, comprising a thin conductive wire, is partially surrounded by a conductive shield with the device being situated in close proximity to the photoconductive surface. The coronode is electrically biased to a high voltage potential, causing ionization of surrounding air which results in the deposit of an electrical charge on an adjacent surface, namely the photoconductive surface of the photoreceptive member.

Corona generating devices are well known, corona devices aid the transfer of the developed toner image from a photoconductive member to a transfer member. Likewise, corona devices aid the conditioning of the photoconductive member prior to, during, and after deposition of developer material thereon to improve the quality of the electrophotographic copy produced thereby. Both direct current (DC) and alternating current (AC) type corona devices are used to perform these functions.

One form of a corona charging device comprises a corona electrode in the form of an elongated wire connected by way of an insulated cable to a high voltage AC/DC power supply. Such corona generating devices may use a variety of biasing techniques. The corona wire is partially surrounded by a conductive shield. The photoconductive member is spaced from the corona wire on the side opposite the shield. The coronode, for example, may be provided with a DC voltage, while the conductive shield is electrically grounded and the photoconductive surface to be charged is mounted on a grounded substrate, spaced from the coronode opposite the shield. Alternatively, the corona device may be biased in a manner wherein the flow of ions from the electrode to the photoconductive surface is regulated by an AC corona generating potential applied to the conductive wire electrode and a DC potential applied to the conductive shield partially surrounding the electrode. The DC potential allows the charge rate to be adjusted, making this biasing system useful for self-regulating systems. Various other corona generating biasing arrangements are known in the art and will not be discussed in great detail herein.

Other forms of corona charging devices are pin corotrons and scorotrons. The pin corotron comprises an array of pins integrally formed from a sheet metal member that is connected by a high voltage cable to a high voltage power supply. The sheet metal member is supported between insulated end blocks and mounted within a conductive shield. The photoconductive member to be charged is spaced from the sheet metal member on the opposite side of the shield. The scorotron is similar to the pin corotron, but is additionally provided with a screen or control grid disposed between a coronode and the photoconductive member. The conductive shield may form a generally U-shaped cross-sectional configuration substantially surrounding the electrode wire. The screen is held at a lower potential approximating the charge level to be placed on the photoconductive member. The scorotron provides for more uniform charging and prevents over charging.

Still other forms of corona charging devices include a dicorotron. The dicorotron comprises a coronode having a conductive wire that is coated with an electrically insulating material. When AC power is applied to the coronode by way of an insulated cable, substantially no net DC current flows in the wire due to the thickness of the insulating material. Thus, when the conductive shield forming a part of dicorotron and the photoconductive member passing thereunder under at the same potential, no current flows to the photoconductive member or the conductive shield. However, when the shield and photoconductive member are at different potentials, for example, when there is a copy sheet attached to the photoconductive member to which toner images have been electrostatically transferred thereto, an electrostatic field is established between the shield and the photoconductive member which causes current to flow from the shield to ground.

When using corona generating devices, a problem arises in that various nitrogen oxide species are produced by the corona. While these nitrogen oxide species are adsorbed by solid surfaces, they have also been observed to be adsorbed by the conductive shield, the housing and various components located within proximity of the corona generating device.

The adsorption process can be a physically reversible process wherein the nitrogen oxide species once adsorbed by the surrounding components are desorbed gradually when the corona device is powered off for extended periods. However, the composition of the species absorbed may not necessarily be the same as the composition of the nitrogen species desorbed and it is well known that a conversion of $NO_2$ to $HNO_3$ may occur. What occurs in the practical sense is readily observable upon powering on the corona device, wherein a defect in copy quality occurs. Known as a parking deletion, this defect entails a line or band image deletion. Another defect may be noticed when the corona device is powered off and remains idle, in particular, a lower density image may appear across the width of the photoreceptor at a location opposite the corona generating device.

The noticeable effect of the above results in a narrow line or solid area images becoming blurred and appearing washed out, as opposed to being developed as a toner image. Over extended periods of idleness, where the photoreceptor is exposed to the desorbing nitrogen oxide species, the line defect and solid area deletions have been noticed to increase in severity. For the initial stage of exposure of the photoreceptor to the desorbing nitrogen oxide species, reaction between the photoreceptor and the nitrogen oxide species occurs primarily at the surface. But, after prolonged exposure, the reaction may penetrate the surface layer of the photoconductive member. Whereas in the former situation, it may be possible to rejuvenate the photoreceptor with a topical cleaning application, it is more difficult in the latter situation.

The prior art reveals various solutions to effect adsorption of the nitrogen oxide species and to retard the desorption effect. In FIG. 2 of U.S. Pat. No. 4,290,266, a dicorotron is disclosed wherein the conductive shield 34 in conjunction with the two vertically extending side panels 32 coated with an aluminum hydroxide electrically conductive film 40 containing particulate graphite and powdered nickel effectively forms a conductive cavity in FIG. 1 of the U.S. Pat. No. 4,290,266. This conductive cavity 41 is represented in FIG. 1 of the present invention. This film 40 resides also on conductive shield 34 and adsorbs and desorbs the nitrogen oxide species, to overall neutralize the nitrogen oxide species when they are generated.

REFERENCES

U.S. Pat. No. 4,842,973, common assigned, discloses the vacuum deposition of selenium alloy on substrates which may be employed in the fabrication of electrophotographic imaging members.

U.S. Pat. No. 6,060,708, assigned to Burle Technologies, Inc., discloses a unitary removable shield, serving the same function as a film or coating of electrically conductive material applied over the conductive cavity of a universally adaptable corona generating or charging device, which is inserted into the cavity to adsorb and desorb nitrogen oxide species produced by negative corona. The unitary removable shield has a generally U-shaped cross-sectional configuration which fits within the cavity. The shield may be retained in the housing by engaging and conforming to the shape of the conductive cavity in a tight frictional fit so as to make electrical contact with the conductive cavity. The shield may also be retained in the housing by tabs or pressure-loadable clips which engage portions of the housing.

U.S. Pat. No. 6,807,389, commonly assigned, discloses an apparatus and process for applying an electrical charge to a photoreceptor wherein a bias charge roll member is situated in contact or in close proximity with a surface of a member to be charged such as a photoreceptor. The bias charge roll member is supplied with an electrical bias having a variable voltage waveform onto which a DC bias is superimposed. The amount of DC bias is selected to set the signal voltage such that a minimally acceptable amount of AC corona is created sufficient for uniform photoreceptor charging while avoiding unnecessary excessive positive corona that causes excessive photoreceptor wear.

U.S. Pat. No. 6,823,157, commonly assigned, discloses a corona generating device, includes a conductor; a grid having a curved surface; and a frame for supporting the grid.

SUMMARY

Aspects disclosed herein include:

a method comprising obtaining a nonconductive substrate; vacuum depositing a material capable of holding a charge but which does not facilitate the development of NOx and/or NOy upon interaction of a charge onto the nonconductive substrate; and placing the vacuum-deposited material substrate in proximity to a charge generating source wherein the vacuum-deposited material is one or more materials selected from the group consisting of: gold, platinum, lead, titanium and alloys thereof;

a charge generating device comprising a discharge electrode; and a conductive shield comprising a nonconductive substrate coated with one or more materials selected from the group consisting of: gold, platinum, lead, titanium and alloys thereof; and an electrophotographic device comprising a photoconductive member; a charge generating element; and a conductive shield interdisposed between the photoconductive member and the charge generating element, the conductive shield comprising a nonconductive substrate coated with one or more materials selected from the group consisting of: gold, platinum, lead, titanium and alloys thereof.

BRIEF DESCRIPTION OF THE DRAWINGS

Various of the above mentioned and further features and advantages will be better understood from this description of embodiments thereof, including the attached drawing figures wherein:

FIG. 1 (prior art) is a perspective view of a corona charging device, in particular, a dicorotron; and FIG. 2 (prior art) is a cross-sectional view taken along line 3-3 of the dicorotron of FIG. 1, including a removable shield in the conductive cavity.

DETAILED DESCRIPTION

In embodiments there is illustrated a charge generating device comprising a discharge electrode; and a conductive shield comprising a nonconductive substrate coated with one or more materials selected from the group consisting of gold, platinum, lead, titanium and alloys thereof.

In one embodiment, there is disclosed a method comprising obtaining a nonconductive substrate; vacuum depositing a material capable of holding a charge but which does not facilitate the development of NOx and/or NOy upon interaction of a charge onto the nonconductive substrate; and placing the vacuum-deposited material substrate in proximity to a charge generating source wherein the vacuum-deposited material is one or more materials selected from the group consisting of gold, platinum, lead, titanium and alloys thereof.

NOx/NOy formation in electrostatographic devices, such as xerographic devices, may produce unwanted picture quality/image quality defects such as positive/negative ghosting, deletions, streaks, etc. Electrostatographic imaging members may be protected by an alkaline-carbon black coating that helps absorb/neutralize ozone by-products that are produced by a charging device. However, such coatings may be insufficient in protecting or require replacement at undesirably frequent intervals. Furthermore, such coating may not hold up to certain cleaning methods employed by users and service representatives to clean the imaging member. Lastly, such coatings may be soft enough to be easily abraded or removed, especially when exposed to solvents such as water or isopropyl alcohol.

In one embodiment, one or more materials selected from the group consisting of gold, platinum, lead, titanium and alloys thereof are vacuum deposited on a nonconductive substrate used in the fabrication of a shield employed in a charge generating device, such as a corona. Such shield may comprise, for example, a plastic or ceramic substrate. The material, such as titanium, may be vacuum deposited onto the shield (e.g., inner plastic shield) that is to be exposed to the corona in a manner to provide for maintaining conductivity required for electrical biasing while preventing NOx/NOy formation. For example, when titanium is vacuum deposited on the inner plastic surface, it may not be removed during cleaning, which provides cost advantages over titanium in sheet form.

The technique of vacuum deposition is well known in the art. In one technique, material is placed in a holding container and heated (alone or in the presence of a solvent) under a partial vacuum in the presence of a substrate to cause deposition of the material onto the substrate. The substrate may or may not be heated. Vacuum deposition may make use of a number of deposition chambers including, for example, a planetary vacuum deposition chamber. The treated substrate may be used in a number of different charge generating devices, including a corotron or dicorotron.

Now turning to FIG. 1, there is illustrated a dicorotron device comprising a corona charging device like a dicorotron device comprising anchors 31, between which is supported at least one elongated conductive corona discharge electrode or dicorotron wire 30 [hereinafter used interchangeably with electrode or wire] with the anchors secured to end blocks 35. A conductive shield 34 is slidably mounted and supported by the bottom of housing 39 and is constructed in a rectangular tubular cross-sectional configuration 8. Handle 36 facilitates the sliding movement. When inserted into the housing, the conductive shield 34 is fastened in place with the aid of spring retaining member 38. A machine high voltage contact pin 33 serves as an electrical contact to provide connection to an AC power supply. Extending from the housing are two vertical side panels 32 formed for the entire length of the dicorotron wire.

The outer portion and inner surfaces of conductive shield 34 are coated with an electrically conductive dry film of aluminum hydroxide containing graphite and nickel powder. A similar film 40 also resides on the side panels such that the side panels and the top portion of the conductive shield form a conductive cavity 41 having a longitudinal opening at the top thereof. Shield 34 and coating 40 are at the same voltage potential. This conductive cavity substantially surrounds the dicorotron wire 30 and has a generally U-shaped cross-sectional configuration.

FIG. 2 shows a perspective view of a removable shield. The removable shield comprises a body 2 having a generally U-shaped cross-sectional configuration which fits within the cavity of the housing and includes tab 5. The body includes a lower surface 4 which is in electrical contact with conductive shield 34. The side surfaces 3 on the exterior of the body are disposed adjacent to sides 32 and may be in electrical contact with the film 40 adhered to sides 32 of the housing when the removable shield is inserted into the conductive cavity 41. Electrode 30 must be removed before the shield is inserted into the housing cavity. A space 6 is defined between conductive shield 34 and at least one side 32 of the housing.

In an embodiment such as set forth in FIG. 2, the removable shield may comprise a nonconductive substrate vacuum-deposited with titanium, or metals such as gold, platinum, or lead and alloys thereof. The titanium may be elemental grade 4 titanium. Such metals have crystalline structures that are not prone to chemical reaction.

The NOy being protected against in such embodiments may comprise NO, $NO_2$, $NO_3$, $N_2O_5$, HONO, $HO_2NO_2$, $C_{10}NO_2$, NO or $NO_2$. The NOx may comprise, for example, NO or $NO_2$.

The charge generating source in the charge generating device may be, for example, a discharge electrode, a corona wire, a corotron wire, dicorotron, wire, etc. The discharge electrode may be partially, or fully, surrounded by a conductive shield. The treated shield may comprise a nonconductive substrate, such as plastic, treated by vacuum-deposition with one or more materials selected from the group consisting of: gold, platinum, lead, titanium and alloys thereof.

The treated shield may be placed between a photoconductive member and the charge generating source or element. The photoconductive member may be comprised of a simple layer or multilayers, as known in the art, of inorganic or organic nature. Organic photoconductors may comprise, for example, undercoat layers, charge transport layers, charge blocking layers and overcoat layers.

While the invention has been particularly shown and described with reference to particular embodiments, it will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method comprising obtaining a nonconductive substrate;

vacuum depositing a material capable of holding a charge but which does not facilitate the development of NOx and/or NOy upon interaction of a charge onto the nonconductive substrate; and placing the vacuum-deposited material substrate in proximity to a charge generating source wherein the vacuum-deposited material is one or more materials selected from the group consisting of: gold, platinum, lead, titanium, and alloys thereof.

2. A method in accordance with claim 1 wherein said vacuum-deposited material is titanium.

3. A method in accordance with claim 2 wherein said titanium is elemental grade 4 titanium.

4. A method in accordance with claim 1 wherein NOy is one or more materials selected from the group consisting of: NO, $NO_2$, $NO_3$, $N_2O_5$, HONO, $HO_2NO_2$, $C_{10}NO_2$ and $HNO_3$.

5. A method in accordance with claim 1 wherein NOx is one or more materials selected from the group consisting of: NO and $NO_2$.

6. A method in accordance with claim 1 wherein said vacuum deposition is done in a planetary vacuum deposition chamber.

7. A method in accordance with claim 1 wherein said charge generating source is a corona wire.

8. A method in accordance with claim 1 wherein said nonconductive substrate comprises plastic.

9. A method in accordance with claim 1 wherein said nonconductive substrate comprises ceramic.

10. A method in accordance with claim 1 further comprising heating the substrate during vacuum deposition of the material.

11. A charge generating device comprising a discharge electrode;

a conductive shield comprising a nonconductive substrate coated with one or more materials selected from the group consisting of: gold, platinum, lead, titanium and alloys thereof.

12. A charge generating device in accordance with claim 11 wherein said one or more materials is titanium.

13. A charge generating device in accordance with claim 12 wherein said titanium is elemental grade 4 titanium.

14. A charge generating device in accordance with claim 11 wherein said discharge electrode is a corotron or dicorotron wire.

15. A charge generating device in accordance with claim 11 wherein said discharge electrode is partially surrounded by the conductive shield.

16. The charge generating device of claim 11 wherein said nonconductive substrate is selected from the group consisting of: plastic and ceramic, or a combination thereof.

17. An electrophotographic device comprising a photoconductive member;

a charge generating element; and a conductive shield interdisposed between said photoconductive member and said charge generating element, said conductive shield comprising a nonconductive substrate coated with one or more materials selected from the group consisting of gold, platinum, lead, titanium and alloys thereof.

18. An electrophotographic device in accordance with claim 17 wherein said one or more materials is titanium.

19. An electrophotographic device in accordance with claim 17 wherein said charge generating element is a wire.

20. An electrophotographic device in accordance with claim 17 wherein said photoconductive member comprises a charge transport layer and a charge blocking layer.

* * * * *